US010100590B2

(12) United States Patent
Clostio, Jr. et al.

(10) Patent No.: US 10,100,590 B2
(45) Date of Patent: Oct. 16, 2018

(54) REMOTE FLUID GRIP TONG

(71) Applicant: Frank's International, LLC, Houston, TX (US)

(72) Inventors: Thomas J. Clostio, Jr., Lafayette, LA (US); Tyler Jabusch, Lafayette, LA (US); Dougal Brown, Forres (GB)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 114 days.

(21) Appl. No.: 15/263,938

(22) Filed: Sep. 13, 2016

(65) Prior Publication Data

US 2018/0073312 A1 Mar. 15, 2018

(51) Int. Cl.

| | |
|---|---|
| ***E21B 19/06*** | (2006.01) |
| ***E21B 19/16*** | (2006.01) |
| ***E21B 19/08*** | (2006.01) |

(52) U.S. Cl.

CPC ..... *E21B 19/06* (2013.01); *E21B 19/08* (2013.01); *E21B 19/16* (2013.01); *E21B 19/161* (2013.01); *E21B 19/163* (2013.01); *E21B 19/165* (2013.01)

(58) Field of Classification Search

CPC ..... E21B 19/00; E21B 19/06; E21B 19/16; E21B 19/163; E21B 19/161; E21B 19/165; E21B 19/08

See application file for complete search history.

(56) References Cited

U.S. PATENT DOCUMENTS

| | | | | |
|---|---|---|---|---|
| 4,811,635 | A * | 3/1989 | Falgout, Sr. | E21B 19/164 81/57.19 |
| 5,174,175 | A * | 12/1992 | Bouligny | B25B 5/065 81/57.19 |
| 8,601,910 | B2 * | 12/2013 | Begnaud | E21B 19/168 166/77.51 |
| 2003/0102136 | A1 * | 6/2003 | Nelson | E21B 33/085 166/387 |
| 2005/0241441 | A1 | 11/2005 | Drzewiecki | |
| 2008/0302530 | A1 * | 12/2008 | Shampine | E21B 33/068 166/250.08 |
| 2012/0111155 | A1 * | 5/2012 | Holen | E21B 19/163 81/57.35 |
| 2013/0232750 | A1 * | 9/2013 | Pullins | E21B 19/10 29/402.09 |

(Continued)

OTHER PUBLICATIONS

Jin Ho Kim (Authorized Officer), International Search Report and Written Opinion dated Sep. 7, 2017, PCT Application No. PCT/US2017/037390, filed Jun. 14, 2017, pp. 1-13.

*Primary Examiner* — Yong-Suk Ro
(74) *Attorney, Agent, or Firm* — MH2 Technology Law Group LLP

(57) ABSTRACT

A tubular gripping assembly includes a power tong housing configured to actuate between an open position and a closed position. An inflatable bladder apparatus is coupled to an inner surface of the power tong housing and configured to grip a tubular member when the power tong housing is in the closed position and the inflatable bladder apparatus is inflated. A latch mechanism, operative in response to a remote control signal provided through a mechanized docking and undocking fluid connector, is configured to secure the power tong housing in the closed position and to allow the power tong housing to actuate to the open position.

24 Claims, 19 Drawing Sheets

(56) References Cited

U.S. PATENT DOCUMENTS

| | | | | |
|---|---|---|---|---|
| 2014/0131052 | A1* | 5/2014 | Richardson | E21B 19/16<br>166/380 |
| 2015/0107850 | A1* | 4/2015 | Mosing | E21B 19/164<br>166/377 |
| 2016/0123094 | A1* | 5/2016 | Amezaga | E21B 19/165<br>166/380 |

* cited by examiner

REMOTE FLUID GRIP TONG

BACKGROUND

Many industrial fields require the gripping of tubular members so that they may be axially-rotated or secured against rotation, most notably in order to assemble and disassemble threaded connections. The oil and gas industry relies heavily on such assembly and disassembly, especially in oil and gas exploration, where a single well can include tubular strings that are thousands of feet in length. These strings include individual tubular members (referred to as "joints") that are threaded together, end-to-end via male and female connectors.

Tongs have been developed to grip tubular members in order to facilitate the repetitive task of assembling and disassembling threaded connections. One type of tong, commonly called a power tong, rotates a first threaded tubular member on its axis, while another type of tong, commonly called a backup tong, secures a second, mating tubular member against rotation.

As wells become increasingly deeper, tubular strings in turn become increasingly long and heavy, subjecting the tubular members and connections to substantial axial loading, as well as to extreme internal and external pressures. Additionally, the liquid and gaseous production fluids transported from the subterranean reservoir to the surface through these tubular strings can be corrosive. To provide a long-life well structure in situations where the produced fluid is known or expected to contain corrosive constituents, the tubular members are selected from a range of corrosive-resistant alloys (CRAs). In order maximize corrosion resistance, even superficial damage to the tubular members is avoided. Mechanical damage to the surface of the tubular members, which may be imparted onto the tubular members during the installation process, has the potential to lead to premature failure of the tubular members in the well. Considering the high cost of CRA tubular members, not to mention the cost, time, and danger associated with failure of the tubular string in a well, care is taken to prevent damage to the tubular members during assembly and disassembly of the threaded connections.

Various mechanical gripping devices for tubular members are known, most of which rely on hardened gripping teeth to penetrate the outer surface of the tubular member to assure a grip sufficient for imparting the high torques necessary to achieve tight, leak-proof connections. Other gripping devices utilize smooth cam gripping surfaces or smooth-faced jaws with frictional material applied to the contact surface to grip the tubular members. There are disadvantages, however, associated with these particular gripping devices, namely that they sometimes cause surface or structural damage to the tubular members.

Accordingly, other devices for gripping tubular goods have been developed, which avoid surface damage or structural deformation. Once such device is a Fluid Grip device, in which an inflatable bladder-like structure grips the tubular members. In contrast to mechanical gripping devices with cam-activated jaws and dies, the Fluid Grip utilizes the introduction of hydraulic fluid flow and pressure to the mechanism to inflate elastomeric bladders to establish a gripping engagement between a rigid outer housing that encases the elastomeric bladders and a tubular member. Further, the rigid outer housing is secured to the main rotating gear of a power tong. When utilized in this manner, a power tong equipped with a Fluid Grip is capable of applying a substantial clamping force that can be used to grip and rotate tubulars for the purpose of making up threaded connections.

Currently, the mechanisms used to control and transmit fluid to the Fluid Grip housings require manual interaction, which presents personnel safety issues. For example, the Fluid Grip housing latch and tong door are manually manipulated, endangering rig personnel. In addition, a pressure release valve generally is manually opened to evacuate the bladders and release the grip, thereby allowing the power tong rotating members to re-establish alignment and facilitate lateral removal of the tool from the tubular. Manual manipulation of the pressure release valve similarly places rig personnel at risk.

SUMMARY

A tubular gripping assembly is disclosed. The tubular gripping assembly includes a power tong housing configured to actuate between an open position and a closed position. An inflatable bladder apparatus is coupled to an inner surface of the power tong housing and configured to grip a tubular member when the power tong housing is in the closed position and the inflatable bladder apparatus is inflated. A latch mechanism, operative in response to a remote control signal provided through a mechanized docking and undocking fluid connector, is configured to secure the power tong housing in the closed position and to allow the power tong housing to actuate to the open position.

In another embodiment, the tubular gripping assembly includes a power tong housing configured to actuate between an open position and a closed position. An inflatable bladder apparatus is coupled to an inner surface of the power tong housing and configured to grip a tubular member when the power tong housing is in the closed position and the inflatable bladder apparatus is inflated. A pressure relief mechanism, operative in response to a remote control signal, is configured to deflate the inflatable bladder apparatus when the power tong housing is actuated to the open position.

A method for connecting two tubular members is also disclosed. The method includes aligning a power tong housing with a center of a well such that a tubular member is positioned within a bore of the power tong housing. An inflatable bladder apparatus is coupled to an inner surface of the power tong housing. The power tong housing is closed in response to a first signal from a remote control panel. A bladder of the inflatable bladder apparatus is inflated in response to a second signal from the remote control panel, thereby causing the inflatable bladder apparatus to grip the tubular member. The power tong housing and the tubular member are rotated when the tubular member is gripped by the inflatable bladder apparatus.

The foregoing summary is intended merely to introduce a subset of the features more fully described of the following detailed description. Accordingly, this summary should not be considered limiting.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
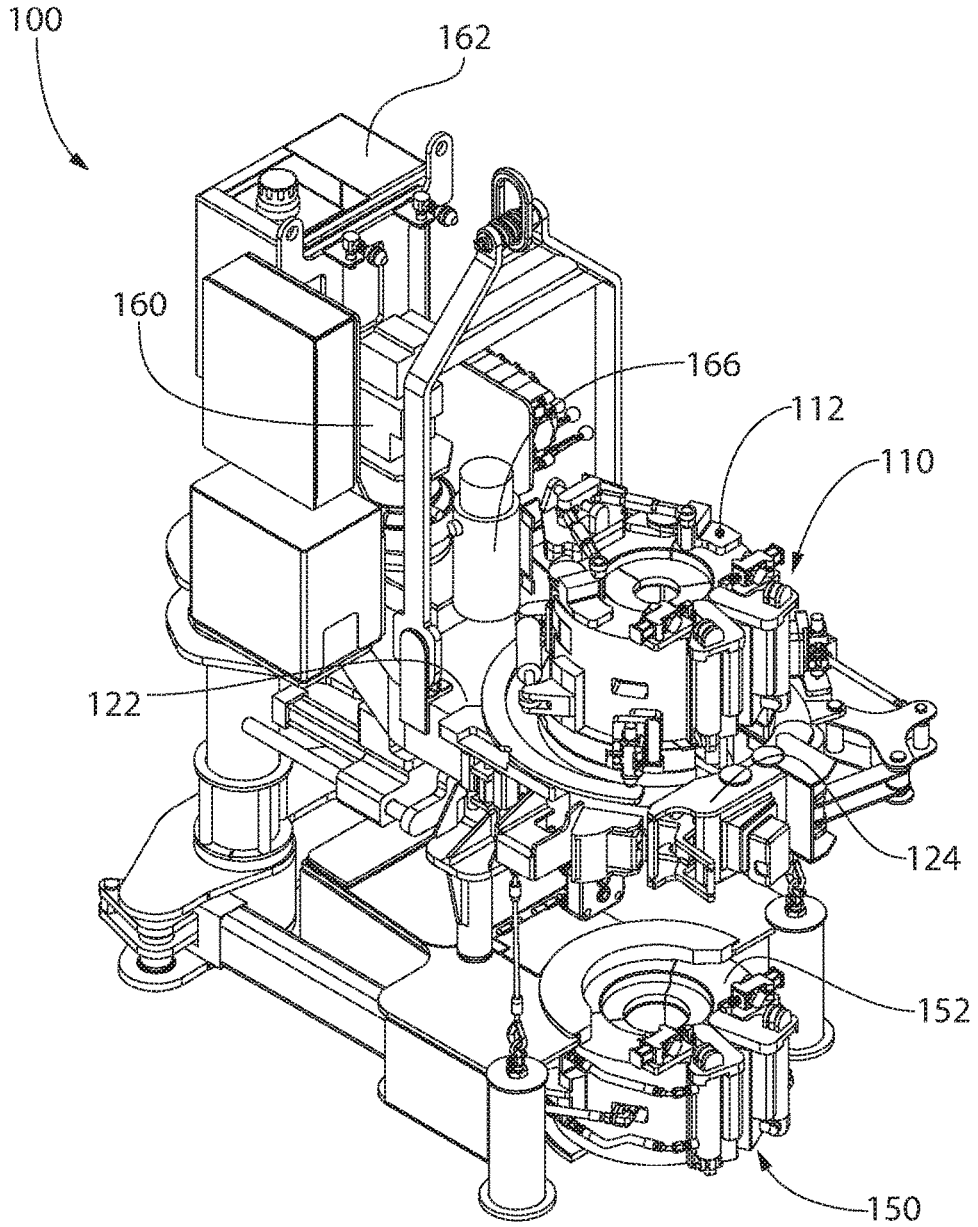
FIG. 1 illustrates a perspective view of tubular gripping assembly, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Embodiments of the present disclosure may provide a Fluid Grip tong that eliminates the need for manual manipulation of the doors, latches, and a pressure release valve. Elimination of such manual manipulation may, in some embodiments, be accomplished via powered actuators designed to manipulate the doors and latches, along with a hydraulic energizing system that allows these operations to be performed via automated remote activation, thereby removing personnel from the hazardous area around the power tong (and well center, in general).

FIG. 1 illustrates a perspective view of tubular gripping assembly 100, according to an embodiment. The tubular gripping assembly 100 may include a power tong 110. The power tong 110 may include a housing 112 (referred to as a power tong Fluid Grip housing). The power tong 110 may also include a body 122. The power tong Fluid Grip housing 112 may be coupled to and/or positioned above the power tong body 122. The power tong Fluid Grip housing 112 may be configured to rotate with respect to the power tong body 122. The power tong body 122 may include a door (referred to as a power tong door) 124. A vertical bore may extend through the power tong Fluid Grip housing 112 and the power tong body 122.

The tubular gripping assembly 100 may also include a backup tong 150. The backup tong 150 may be positioned below the power tong 110. The backup tong 150 may also include a Fluid Grip housing 152. The backup tong Fluid Grip housing 152 may have a vertical bore formed therethrough that is aligned with the bore of the power tong 110.

The tubular gripping assembly 100 may also include a primary hydraulic fluid power source that supplies hydraulic flow and pressure to a drive motor 160 for the power tong 110. The primary hydraulic fluid power source may also supply a power pack 162.

The tubular gripping assembly 100 may also include a suction cylinder 166. The suction cylinder 166 may have a plunger, a piston, and a biasing member (e.g., a spring) positioned at least partially therein. The suction cylinder 166 may be used to inflate and deflate one or more bladders, as discussed below.

Figure 2A:
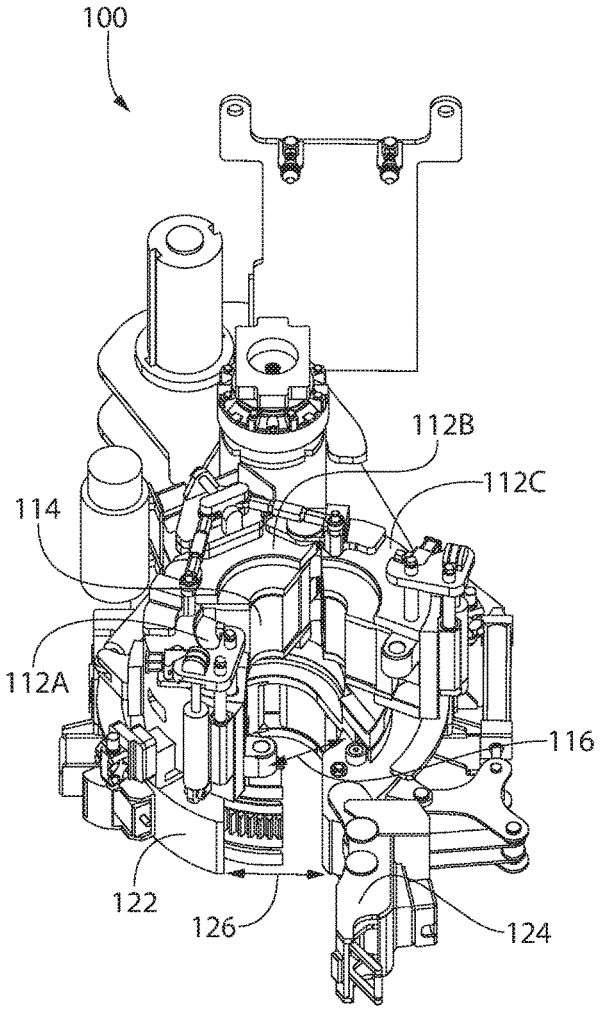
FIG. 2A illustrates a perspective view of a portion of the tubular gripping assembly showing a slot in a housing of a power tong misaligned with a slot in a body of the power tong, according to an embodiment.
Figure 2B:
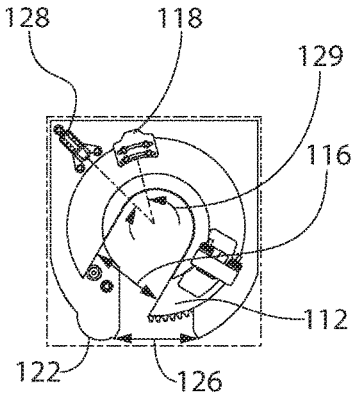
FIG. 2B illustrates a top view of the portion of the tubular gripping assembly shown in FIG. 2A showing the slot in the housing of the power tong misaligned with the slot in the body of the power tong, according to an embodiment.

FIGS. 2A and 2B illustrate a perspective view and a top view, respectively, of a portion of the tubular gripping assembly 100 showing a slot 116 in the power tong Fluid Grip housing 112 misaligned with a slot 126 in the power tong body 122, according to an embodiment. The power tong Fluid Grip housing 112 may include two or more segments (three are shown: 112A, 112B, 112C) that are circumferentially-adjacent to one another. The segments 112A, 112B, 112C may be connected together with hinges that allow the segments 112A, 112B, 112C to pivot with respect to one another to actuate from a closed position (see FIG. 1) to an open position (see FIGS. 2A and 2B).

One or more Fluid Grip apparatuses 114 may be coupled to the inner surfaces of the segments 112A, 112B, 112C. The Fluid Grip apparatuses 114 may be configured to grip a tubular member about its external diameter without causing surface or structural damage to the tubular member. The Fluid Grip apparatuses 114 may include a pliable, generally cylindrical sleeve having an axial bore slightly larger than the external diameter of the tubular member to be gripped. The Fluid Grip apparatuses 114 may also include inflatable bladder segments located in the annular space between the exterior of the pliable sleeve and the interior of the power tong Fluid Grip housing 112. When fluid pressure is introduced into the inflatable bladder segments, the inflatable bladder segments expand and urge the pliable sleeve radially-inward to establish frictional engagement with the tubular member.

When the power tong Fluid Grip housing 112 is in the closed position, and the inflatable bladder segments are inflated, the Fluid Grip apparatuses 114 may grip the tubular member. Once the tubular member is gripped, the power tong Fluid Grip housing 112 may rotate with respect to the power tong body 122 to rotate the tubular member, which couples the tubular member to another tubular member. Illustrative Fluid Grip apparatuses may be found in U.S. Pat. Nos. 4,989,909; 5,174,175; and 6,488,323, which are incorporated by reference herein to the extent that they are not inconsistent with the present disclosure.

A slot 116 is defined in the power tong Fluid Grip housing 112 (e.g., between segments 112A, 112C). A slot 126 is also defined in the power tong body 122. As shown in FIGS. 2A and 2B, after the power tong Fluid Grip housing 112 rotates, the slot 116 of the power tong Fluid Grip housing 112 may be misaligned with (i.e., rotationally-offset from) the slot 126 of the power tong body 122. As a result, the power tong Fluid Grip housing 112 cannot be opened.

In at least one embodiment, the power tong 110 may include an auto-align valve 128 and a target block 118. As shown, the auto-align valve 128 may be coupled to the power tong body 122, and the target block 118 may be coupled to the power tong Fluid Grip housing 112. The auto-align valve 128 and the target block 118 may be configured to communicate with one another to determine whether the slot 116 in the power tong Fluid Grip housing 112 and the slot 126 in the power tong body 122 are aligned or misaligned. When the auto-align valve 128 is aligned with the target block 118, the auto-align valve 128 may be actuated and stop rotation of the power tong Fluid Grip housing 112 for a period of time. The slots 116, 126 are aligned by the stop of the rotation.

Figure 2C:
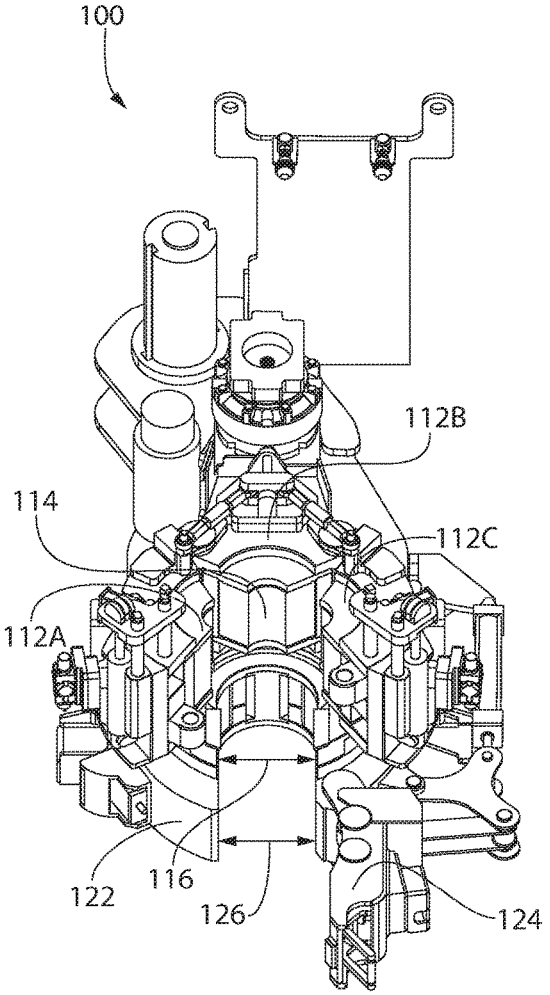
FIG. 2C illustrates a perspective view of the portion of the tubular gripping assembly shown in FIG. 2A showing the slot in the housing of the power tong aligned with the slot in the body of the power tong, according to an embodiment.
Figure 2D:
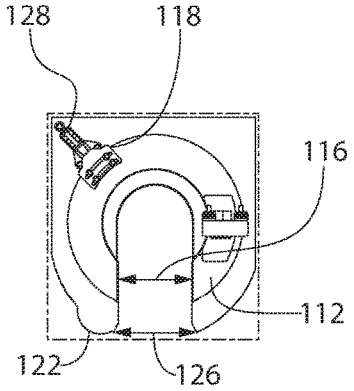
FIG. 2D illustrates a top view of the portion of the tubular gripping assembly shown in FIG. 2C showing the slot in the housing of the power tong aligned with the slot in the body of the power tong, according to an embodiment.

FIGS. 2C and 2D illustrate a perspective view and a top view of a portion of the tubular gripping assembly 100 showing the slot 116 in the power tong Fluid Grip housing 112 aligned with the slot 126 in the power tong body 122, according to an embodiment. When the slots 116, 126 are aligned, a tubular member may pass laterally-through the slots 116, 126 (e.g., be inserted into and/or removed from the bore of the power tong 110).

Figure 3A:
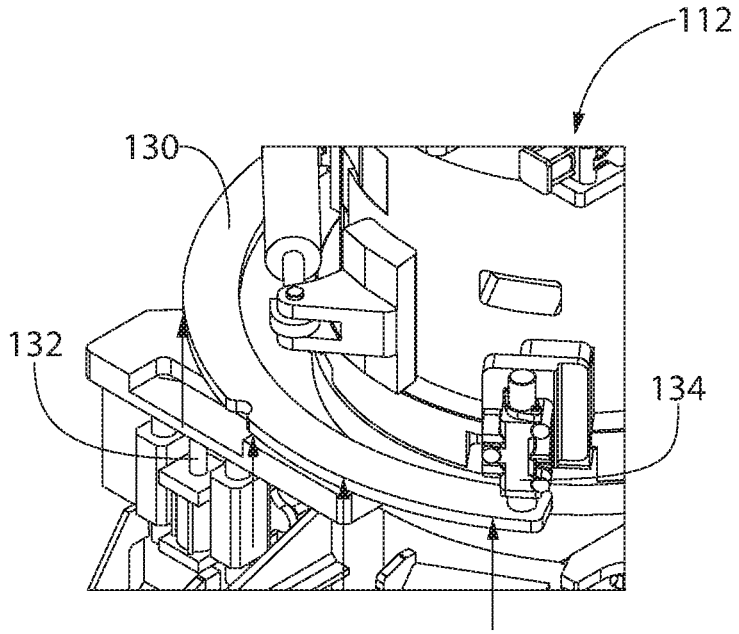
FIG. 3A illustrates a perspective view of a portion of the housing of the power tong showing equalizing plates extended, according to an embodiment.
Figure 3B:
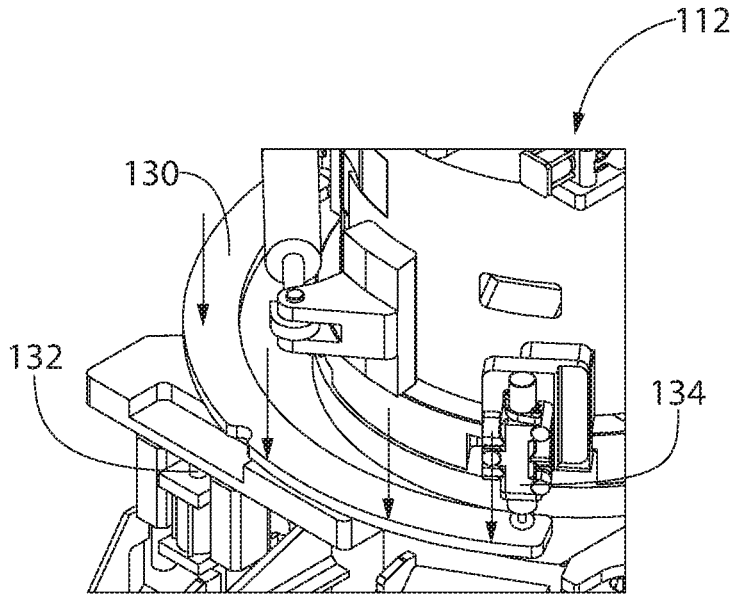
FIG. 3B illustrates a perspective view of the portion of the housing of the power tong shown in FIG. 3A showing the equalizing plates retracted, according to an embodiment.

FIGS. 3A and 3B illustrate perspective views of a portion of the power tong Fluid Grip housing 112 showing equalizing plates 130 in an extended position and a retracted position, respectively, according to an embodiment. The power tong 110 may include one or more equalizing plates (one is shown: 130). Although not shown, in at least one embodiment, the power tong 110 may include two equalizing plates 130 that are circumferentially-offset from one another. The equalizing plate 130 may be configured to be actuated between an extended position (FIG. 3A) and a retracted position (FIG. 3B) by one or more equalizing cylinders 132. As shown, the equalizing cylinder 132 is positioned below the equalizing plate 130 and configured to push the equalizing plate 130 upward to actuate the equalizing plate 130 into the extended position.

The power tong 110 may also include one or more pressure relief mechanisms (one is shown: 134). The pressure relief mechanism 134 may be or include a pressure-equalizing valve. Although not shown, in at least one embodiment, the power tong 110 may include two pressure-equalizing valves 134 that are circumferentially-offset from one another. The pressure-equalizing valve 134 may be in a first (e.g., non-actuated) position, as shown in FIG. 3B, when the equalizing plate 130 is in the retracted position. When the equalizing plate 130 actuates into the extended position, the equalizing plate 130 may contact the pressure-equalizing valve 134 and actuate the pressure-equalizing valve 134 into a second (e.g., actuated) position, as shown in FIG. 3A.

When the pressure-equalizing valve 134 is in the first (e.g., non-actuated) position, fluid pressure in the inflatable bladder segments may be trapped due to valves being in a blocked/closed position. When the pressure-equalizing valve 134 is in the second (e.g., actuated) position, the pressure-equalizing valve 134 may place the suction side of the suction cylinder 166 in fluid communication with the inflatable bladder segments in the Fluid Grip apparatuses 114. This may allow the fluid previously trapped in the Fluid Grip bladders to be discharged to the suction cylinder 166.

Figure 4A:
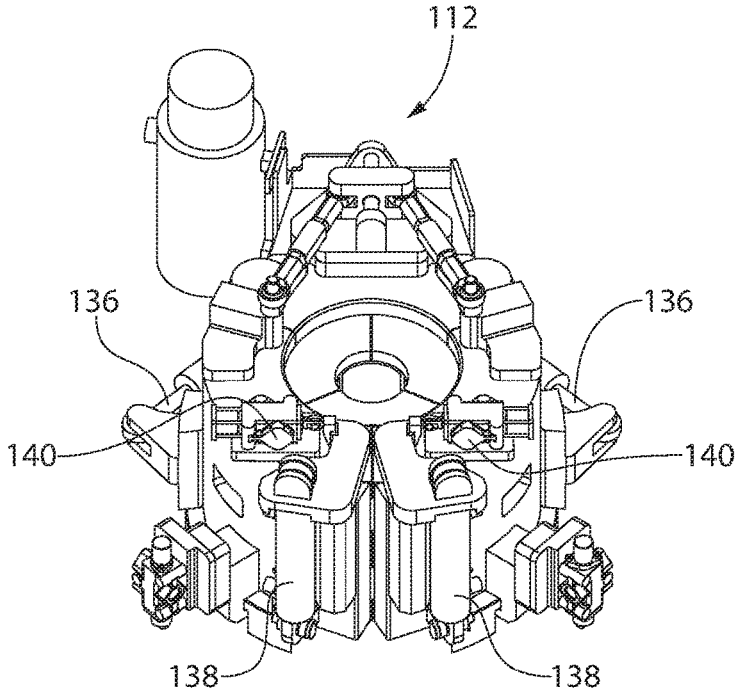
FIG. 4A illustrates a perspective view of the housing of the power tong in a closed position, according to an embodiment.
Figure 4B:
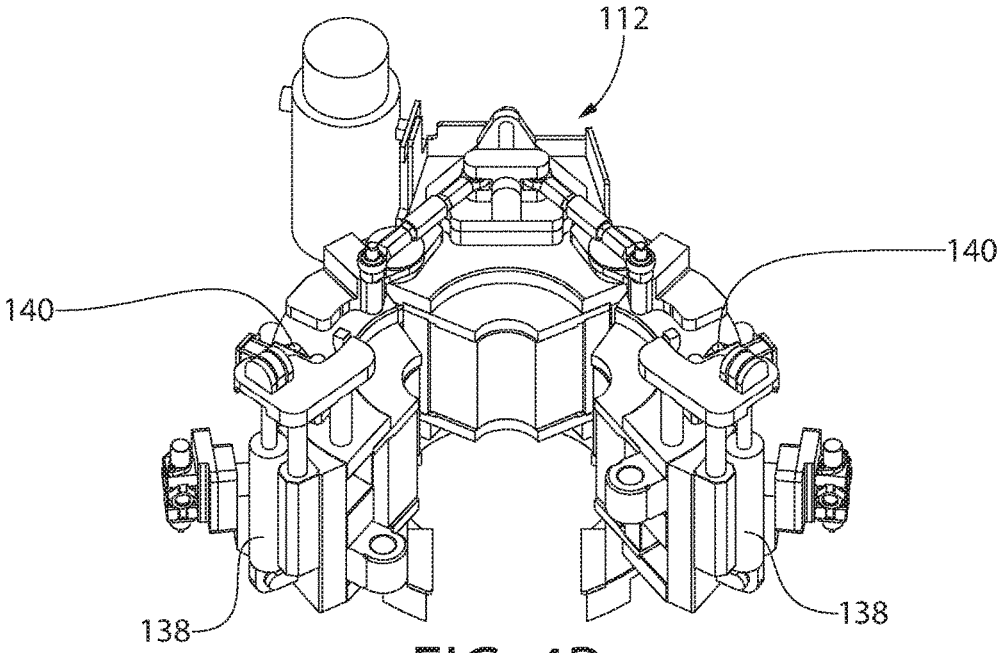
FIG. 4B illustrates a perspective view of the housing of the power tong in an open position, according to an embodiment.

FIGS. 4A and 4B illustrate perspective views of the power tong Fluid Grip housing 112 in a closed position and an open position, respectively, according to an embodiment. The power tong Fluid Grip housing 112 may include one or more hydraulic actuators (two are shown in FIG. 4A: 136). The hydraulic actuators 136 may be cylinders that are configured to actuate the power tong Fluid Grip housing 112 between the closed position (FIG. 4A) and the open position (FIG. 4B).

The power tong Fluid Grip housing 112 may also include one or more latch mechanisms. The latch mechanisms may be or include latch cylinders (two are shown: 138) and/or latch actuators (two are shown: 140). When the power tong Fluid Grip housing 112 is in the closed position, the latch actuators 140 may cause the latch cylinders 138 to lower/retract (e.g., engage), which secures the power tong Fluid Grip housing 112 in the closed position. The latch actuators 140 may also cause the latch cylinders 138 to rise/extend (e.g., disengage), which may enable the power tong Fluid Grip housing 112 to be actuated into the open position.

Figure 5A:
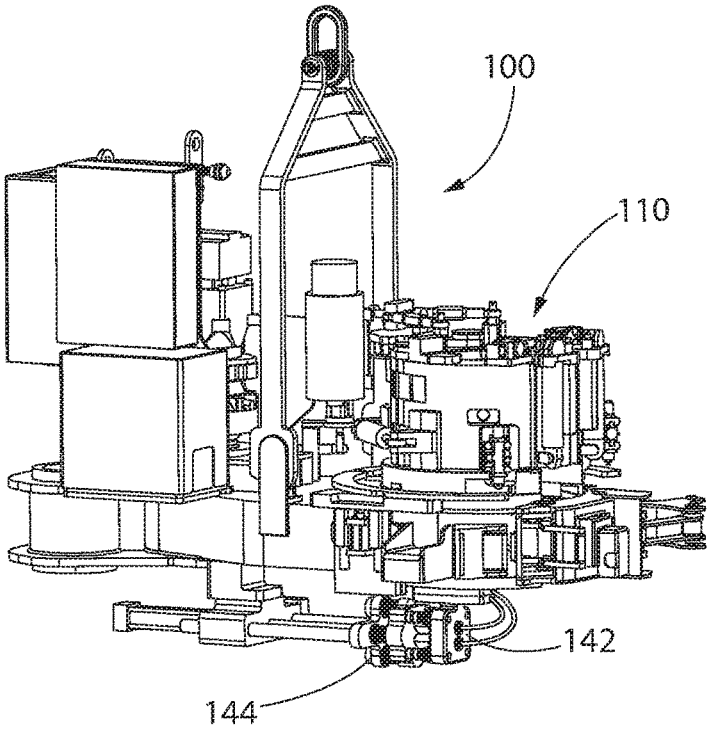
FIG. 5A illustrates a perspective view of a portion of the tubular gripping assembly showing a mechanized docking and undocking fluid connector extended and docked, according to an embodiment.
Figure 5B:
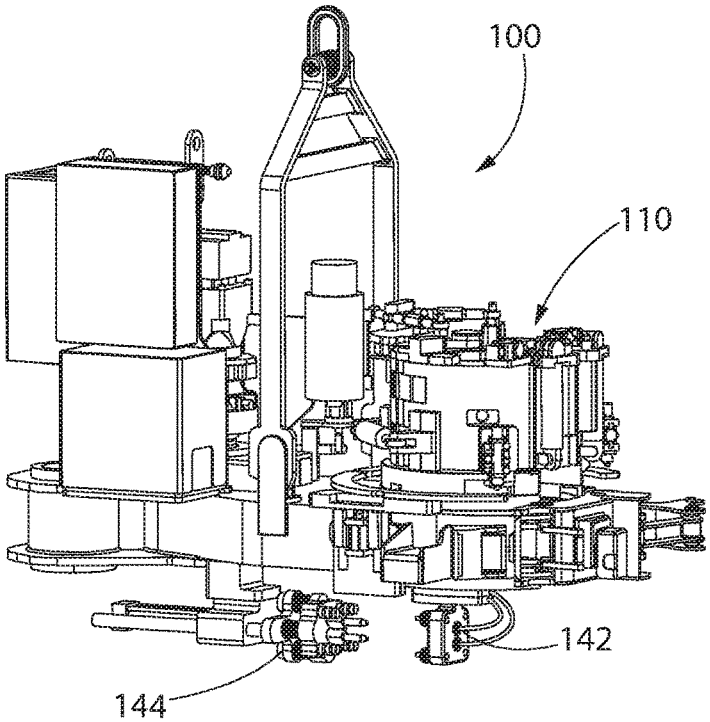
FIG. 5B illustrates a perspective view of the portion of the tubular gripping assembly shown in FIG. 5A showing the mechanized docking and undocking fluid connector retracted and undocked, according to an embodiment.

FIGS. 5A and 5B illustrate perspective views of a portion of the tubular gripping assembly 100 showing a mechanized docking and undocking fluid connector 142 docked (FIG. 5A) and undocked (FIG. 5B), according to an embodiment. The tubular gripping assembly 100 may include the mechanized docking and undocking fluid connector 142 and an arm 144. The arm 144 is configured to extend and retract. In one embodiment, the mechanized docking and undocking fluid connector 142 is described as being a multi-port connector, but other suitable movable connectors for electrical, hydraulic, and/or pneumatic fluid may be used. The multi-port connector 142 may dock with the arm 144 when the arm 144 is extended, and the multi-port connector 142 may be undocked with the arm 144 when the arm 144 is retracted. When the multi-port connector 142 is docked, hydraulic communication may be provided to the power tong 110. The hydraulic communication may be used to actuate the power tong Fluid Grip housing 112 between the open and closed positions, inflate and deflate the bladders in the Fluid Grip apparatuses 114, and actuate the housing latch cylinders 138. When the multi-port connector 142 is undocked, hydraulic communication may not be provided to the power tong 110.

Figure 6:
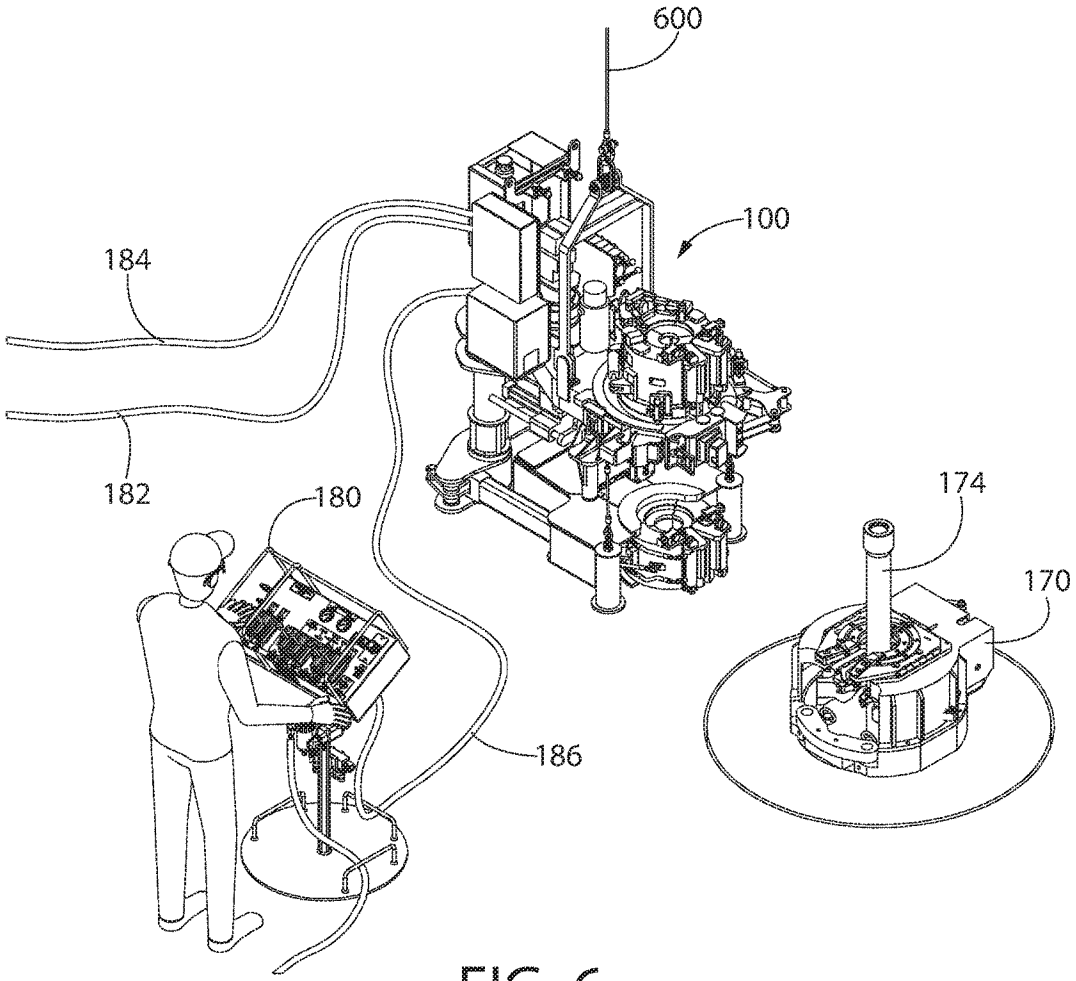
FIG. 6 illustrates a perspective view of the tubular gripping assembly hanging from a derrick, according to an embodiment.

FIG. 6 illustrates a perspective view of the tubular gripping assembly 100 hanging from a derrick by a cable 600, according to an embodiment. As shown, the tubular gripping assembly 100 may initially be laterally-offset from a center of a well. The cable 600 may be configured to move the tubular gripping assembly 100 laterally toward and/or away from the center of the well. At the center of the well, a spider 170 may support a tubular member 174 in rotary.

A first line 182 may be coupled to the tubular gripping assembly 100 and provide hydraulic fluid thereto. A second line 184 may be coupled to the tubular gripping assembly 100 and receive hydraulic fluid therefrom. A third line 186 may be coupled to the tubular gripping assembly 100 and transmit control signals thereto from a remote control panel 180. In another embodiment, the remote control panel 180 may transmit the control signals to the tubular gripping assembly 100 wirelessly. The control signals may be used to actuate the power tong Fluid Grip housing 112 between the open and closed positions, actuate the power tong door 124 between the open and closed positions, dock and undock the multi-port connector 142, inflate the bladders of the Fluid Grip apparatuses 114, and actuate the power tong motor, which causes the power tong Fluid Grip housing 112 to rotate with respect to the backup tong Fluid Grip housing 122. The remote control panel 180 may also be used to cause the cable 600 to move the tubular gripping assembly 100 with respect to the center of the well. Thus, the remote control panel 180 may allow each of these functions to be performed without the conventional manual manipulation, allowing the user to be positioned safely away from the moving machinery.

Figure 7:
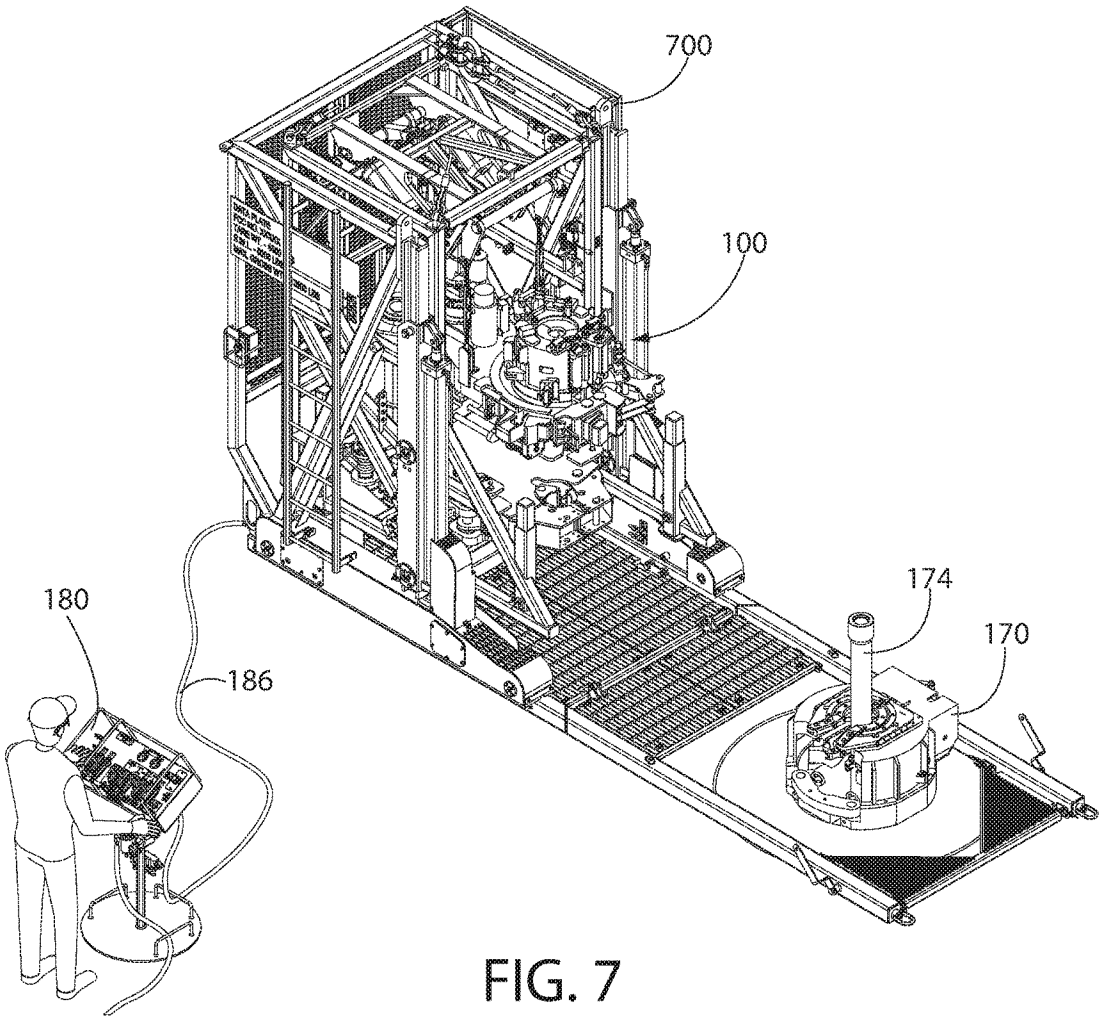
FIG. 7 illustrates a perspective view of the tubular gripping assembly being positioned in a carriage, according to an embodiment.

FIG. 7 illustrates a perspective view of the tubular gripping assembly 100 positioned in a carriage 700, according to an embodiment. The carriage 700 may provide an alternate way to move/transport the tubular gripping assembly 100 toward and/or away from the center of the well. Although not shown, in other embodiments, the tubular gripping assembly 100 may be moved toward and/or away from the center of the well using a crane with a retractable arm, an air hoist, a tong pusher arm, a tong manipulator arm, or the like.

Figure 8:
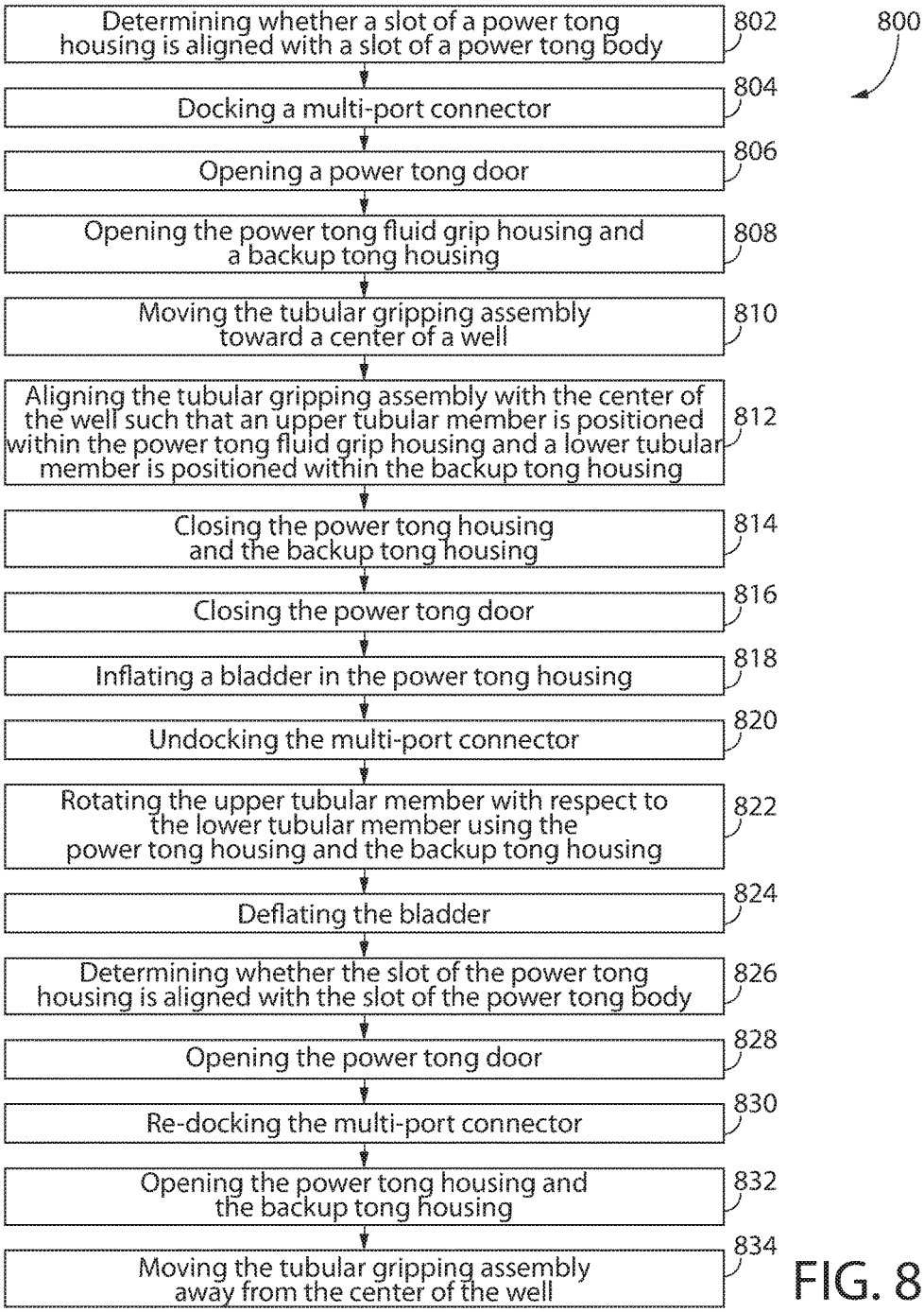
FIG. 8 illustrates a flowchart of a method for connecting two tubular members using the tubular gripping assembly, according to an embodiment.

FIG. 8 illustrates a flowchart of a method 800 for connecting two tubular members 172, 174 together using the tubular gripping assembly 100, according to an embodiment. The method 800 may be viewed together with FIG. 9-16, which illustrate various stages of the method 800. The method 800 may include determining whether the slot 116 of the power tong Fluid Grip housing 112 is aligned with the slot 126 of the power tong body 122, as at 802. The alignment may be determined using the auto-align valve 128 and the target block 118 described above with reference to FIGS. 2A-D. If it is determined that the slots 116, 126 are not aligned, the power tong Fluid Grip housing 112 may be rotated with respect to the power tong body 122 until the slots 116, 126 are aligned.

The method 800 may also include docking the multi-port connector 142 (e.g., by extending the arm 144), as at 804. When the multi-port connector 142 is docked, hydraulic communication may be provided to the power tong Fluid Grip housing 112.

The method 800 may also include opening the power tong door 124, as at 806. The method 800 may also include opening the power tong Fluid Grip housing 112 and the backup tong Fluid Grip housing 152, as at 808. The power tong Fluid Grip housing 112 may be opened after the power tong door 124 is opened. As discussed above, to open the power tong Fluid Grip housing 112, the latch cylinders 138 may extend (e.g., disengage), and then the hydraulic actuators 136 may actuate the power tong Fluid Grip housing 112 into the open position, as shown in FIG. 4B.

Figure 9:
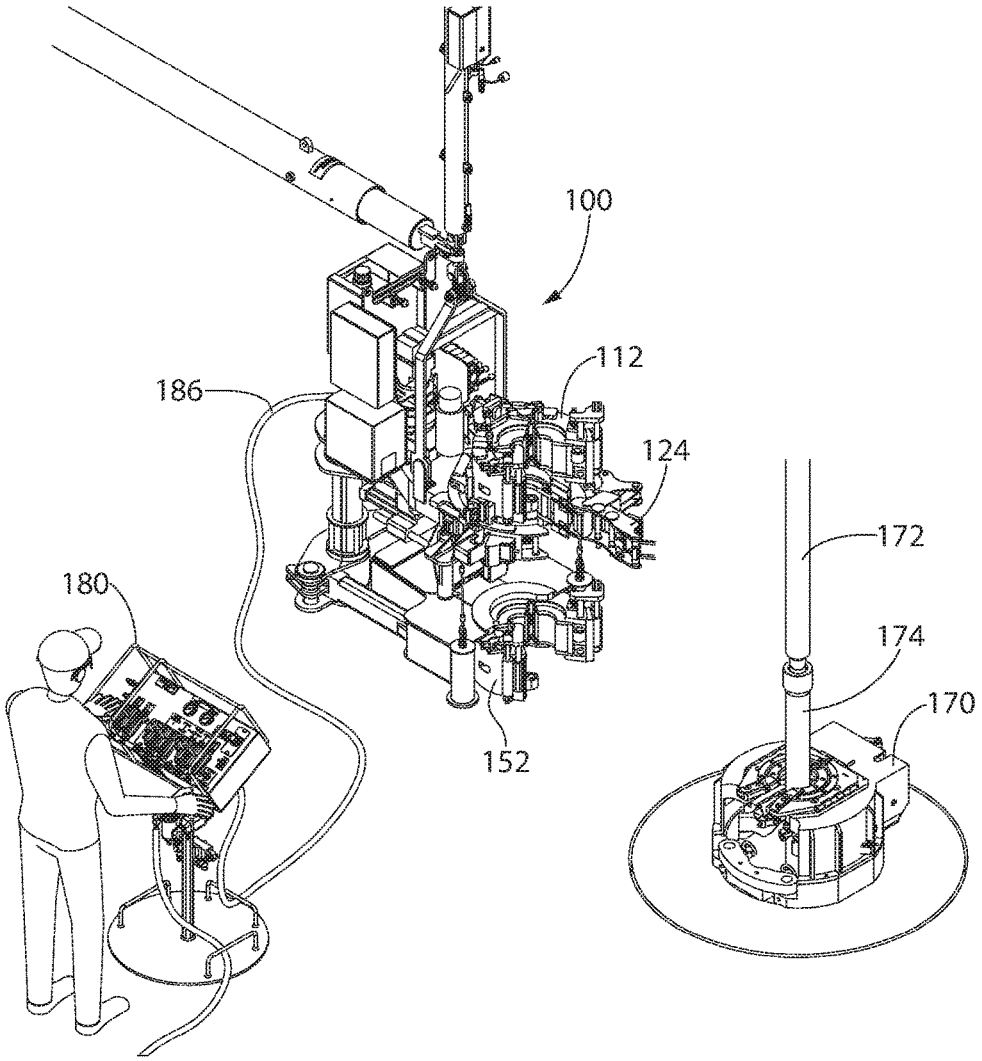
FIG. 9 illustrates a perspective view of the tubular gripping assembly moving toward the center of the well, according to an embodiment

The method 800 may include moving the tubular gripping assembly 100 toward a center of a well, as at 810. This is shown in FIG. 9. The tubular gripping assembly 100 may be suspended by the cable 600 or positioned in the carriage 700 when moved toward the center of the well.

Figure 10:
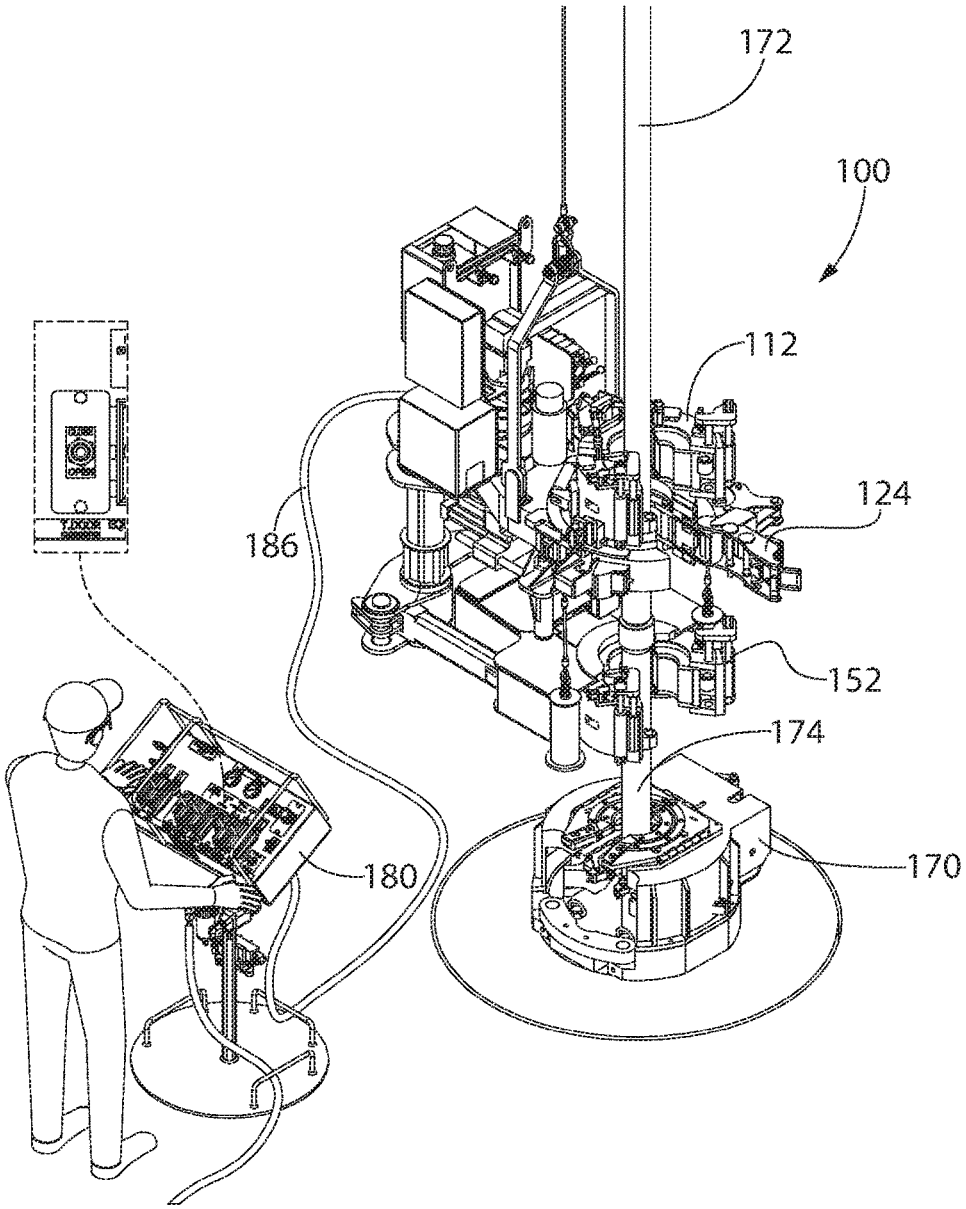
FIG. 10 illustrates a perspective view of the tubular gripping assembly aligned with the center of the well and having an upper tubular member positioned therein, according to an embodiment.

The method 800 may also include aligning the tubular gripping assembly 100 with the center of the well such that at least one tubular member 172, 174 is positioned at least partially within the tubular gripping assembly 100, as at 812. In one example, the tubular gripping assembly 100 may be moved until a first (e.g., upper) tubular member 172 is inserted through the aligned slots 116, 126 in the power tong Fluid Grip housing 112 and the power tong body 122, such that the upper tubular member 172 is positioned within the bore of the power tong Fluid Grip housing 112. This is shown in FIG. 10. Also shown in FIG. 10, when the tubular gripping assembly 100 is aligned with the center of the well, a second (e.g., lower) tubular member 174 may be inserted through the slot in the backup tong Fluid Grip housing 152, such that the lower tubular member 174 is positioned within the bore of the backup tong Fluid Grip housing 152. In another example, one of the upper and lower tubular members 172, 174 may not be present when the tubular gripping assembly 100 is aligned with the center of the well.

Figure 11:
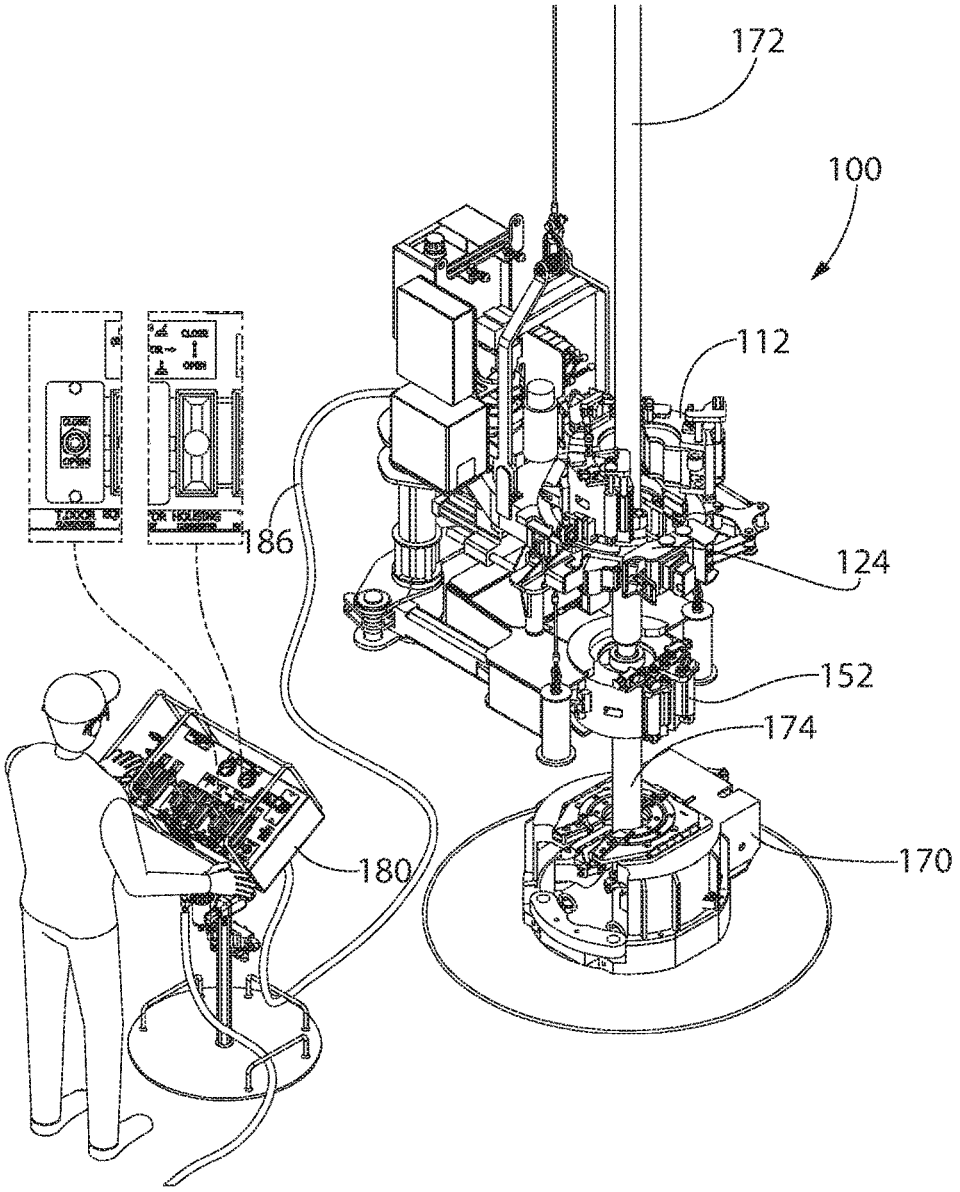
FIG. 11 illustrates a perspective view of the tubular gripping assembly preparing to connect the upper tubular member to a lower tubular member, according to an embodiment.

The method 800 may also include closing the power tong Fluid Grip housing 112 and closing the backup tong Fluid Grip housing 152, as at 814. This is shown in FIG. 11. In at least one embodiment, the power tong door 124 may remain in the open position when the power tong Fluid Grip housing 112 and/or the backup tong Fluid Grip housing 152 are closed. The power tong Fluid Grip housing 112 may be closed with the hydraulic actuators 136. Once in the closed position, the latch actuators 140 may cause the latch cylinders 138 to lower (e.g., engage), which secures the power tong Fluid Grip housing 112 in the closed position.

Figure 12:
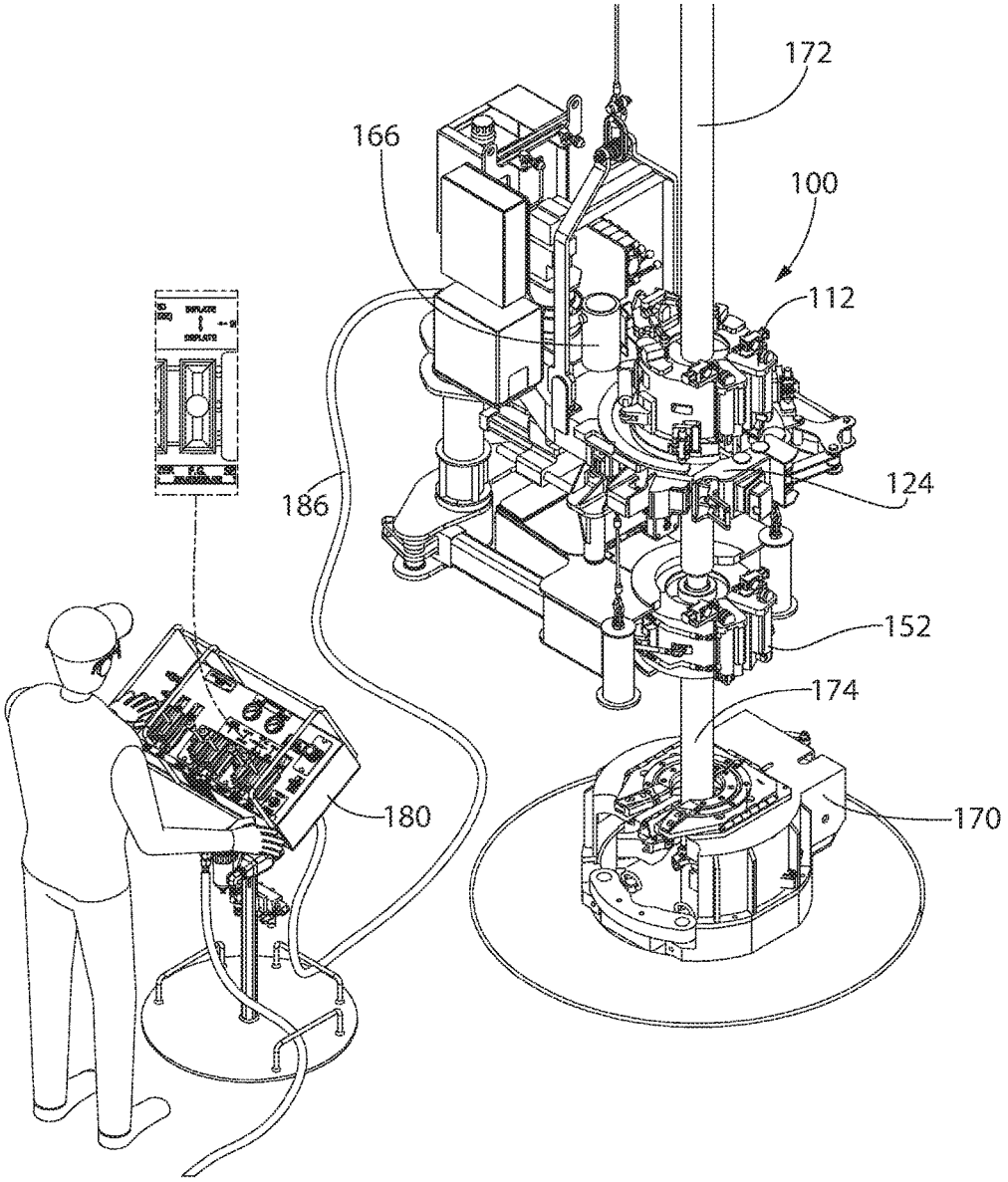
FIG. 12 illustrates a perspective view of the tubular gripping assembly with the bladders pressurized and the suction cylinder retracted, according to an embodiment.

The method 800 may also include closing the power tong door 124, as at 816. The power tong door 124 may be closed after the power tong Fluid Grip housing 112 is closed. This is shown in FIG. 12. The method 800 may also include inflating the bladders in the power tong Fluid Grip housing 112, as at 818. This is also shown in FIG. 12. The bladders may be inflated, and the suction cylinder 166 into the retracted position simultaneously. Once the bladders are inflated, the Fluid Grip apparatuses 114 may grip the upper tubular member 172. The bladders in the backup tong Fluid Grip housing 152, if present, may also be inflated to grip the lower tubular member 174.

Figure 13:
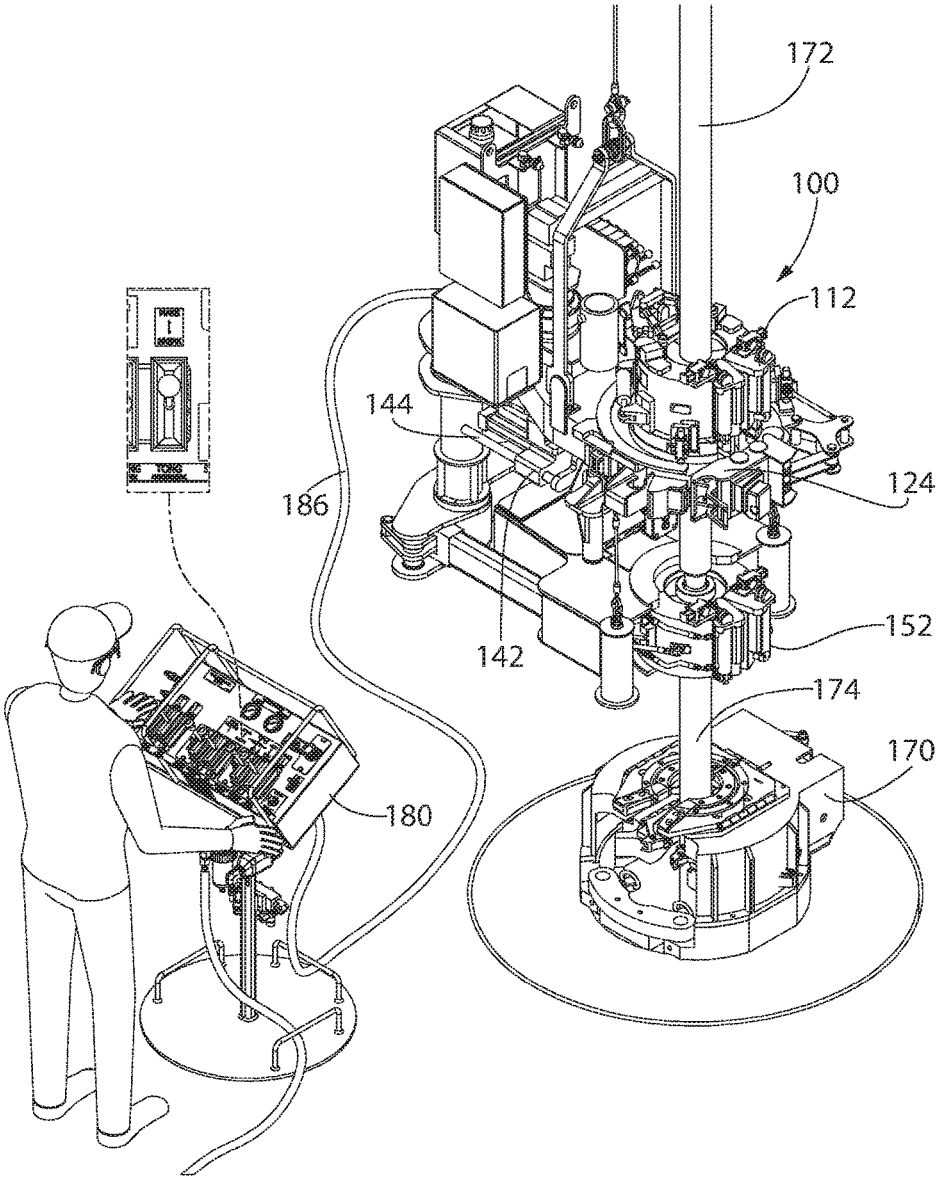
FIG. 13 illustrates a perspective view of the tubular gripping assembly connecting the upper tubular member to the lower tubular member, according to an embodiment.

The method 800 may also include undocking the multi-port connector 142, as at 820. The multi-port connector 142 may be undocked by retracting the arm 144. This is shown in FIG. 13. When the multi-port connector 142 is undocked, hydraulic communication to the power tong 110 may be interrupted/prevented.

The method 800 may also include rotating the upper tubular member 172 with respect to the lower tubular member 174 using the power tong Fluid Grip housing 112 and the backup tong Fluid Grip housing 152, as at 822. This is also shown in FIG. 13. More particularly, the upper tubular member 172 may be rotated using the power tong Fluid Grip housing 112 while the backup tong Fluid Grip housing 152 holds the lower tubular member 174 rotationally stationary. The upper tubular member 172 may be rotated in a first direction to couple the upper and lower tubular members 172, 174 together. The upper tubular member 172 may be rotated in a second, opposing direction to decouple the upper and lower tubular members 172, 174.

Figure 14:
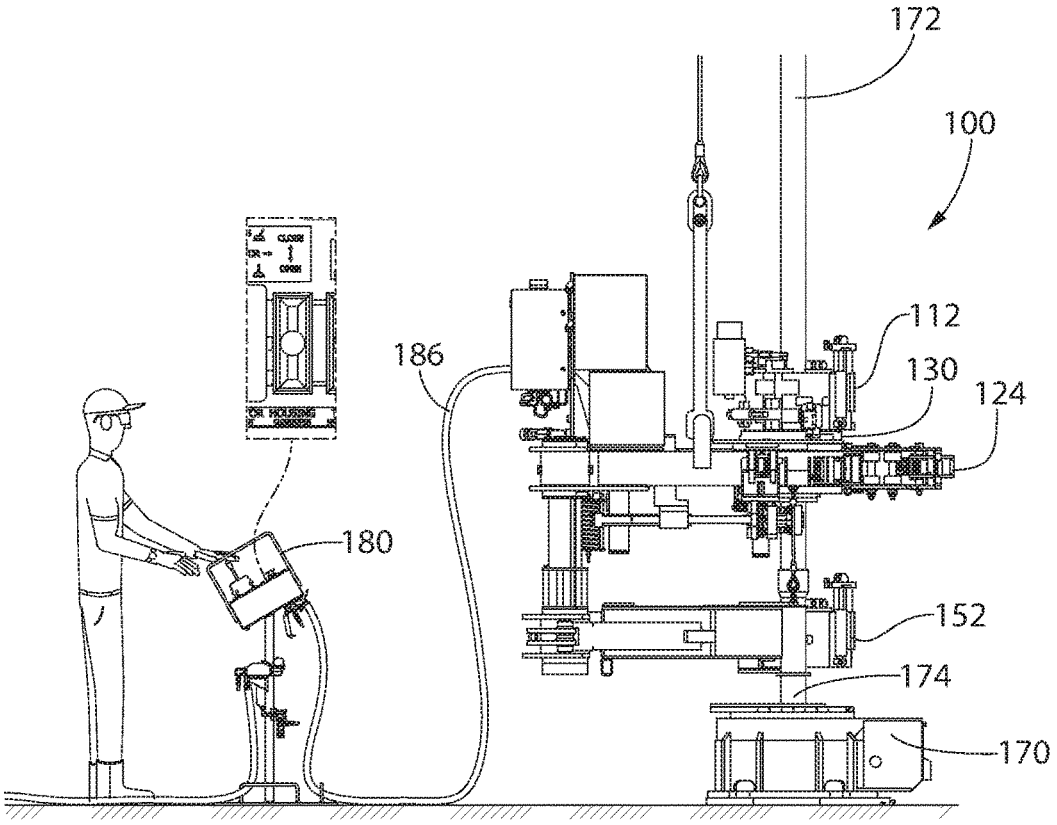
FIG. 14 illustrates a side view of the tubular gripping assembly with energizing pressure being released from the bladders, according to an embodiment.

The method 800 may also include deflating the bladders, as at 824. More particularly, hydraulic pressure may be supplied to the equalizing cylinders 132, which may move (e.g., raise or lower) the equalizing plates 130. Moving the equalizing plates 130 may cause the pressure-equalizing valve 134 to place the suction side of the suction cylinder 166 in fluid communication with the bladders in the Fluid Grip apparatuses 114. In response to this, the fluid in the bladders may be withdrawn into the suction side of the suction cylinder 166, causing the bladders to deflate. When the bladders deflate, the Fluid Grip apparatuses 114 in the power tong Fluid Grip housing 112 may no longer grip the upper tubular member 172. This is shown in FIG. 14.

The method 800 may also include determining whether the slot 116 of the power tong Fluid Grip housing 112 is aligned with the slot 126 of the power tong body 122, as at 826. The alignment may be determined using the auto-align valve 128 and the target block 118 described above with reference to FIGS. 2A-D. If it is determined that the slots 116, 126 are not aligned, the power tong Fluid Grip housing 112 may be rotated with respect to the power tong body 122 until the slots 116, 126 are aligned. The upper tubular member 172 may not be rotated during alignment because the Fluid Grip apparatuses 114 are no longer gripping the upper tubular member 172.

Figure 15:
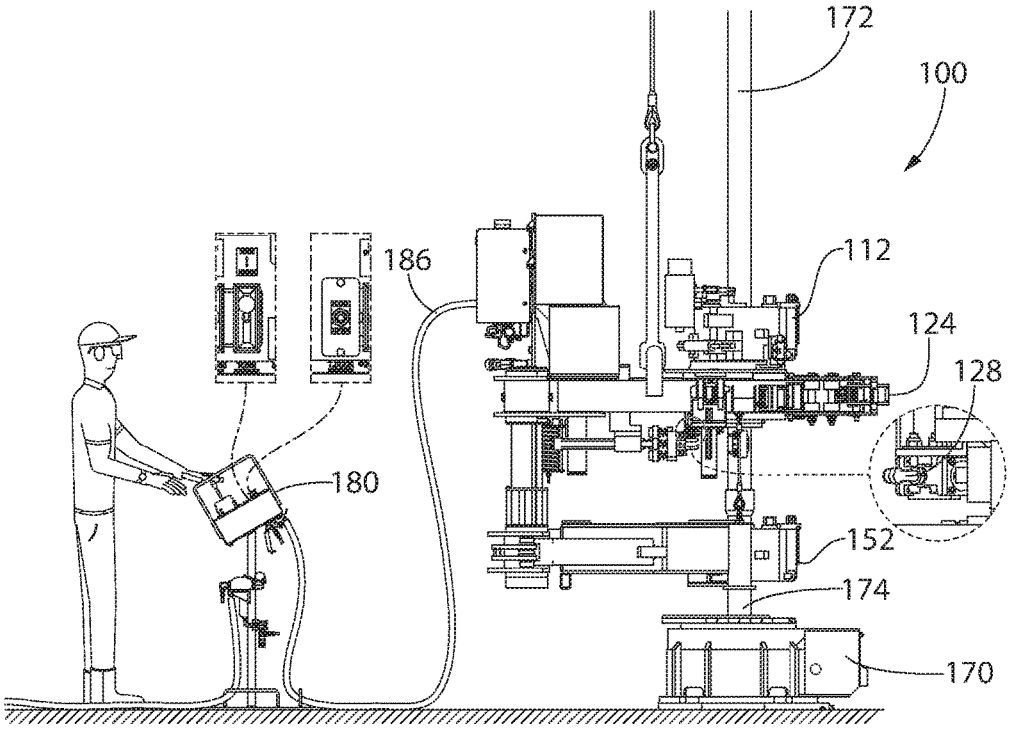
FIG. 15 illustrates a side view of the tubular gripping assembly aligning the housing of the power tong with the body of the power tong, according to an embodiment.

The method 800 may also include opening the power tong door 124, as at 828. This is shown in FIG. 15. The method 800 may also include re-docking the multi-port connector 142, as at 830. The multi-port connector 142 may be re-docked by extending the arm 144. When the multi-port connector 142 is re-docked, hydraulic communication to the power tong Fluid Grip housing 112 may be reestablished. More particularly, any residual hydraulic fluid stored on the spring side of the suction cylinder 166 may flow into the reservoir in the power pack 162. If bladders are present and inflated on the backup tong Fluid Grip housing 152, the bladders may be deflated by the power pack 162.

Figure 16:
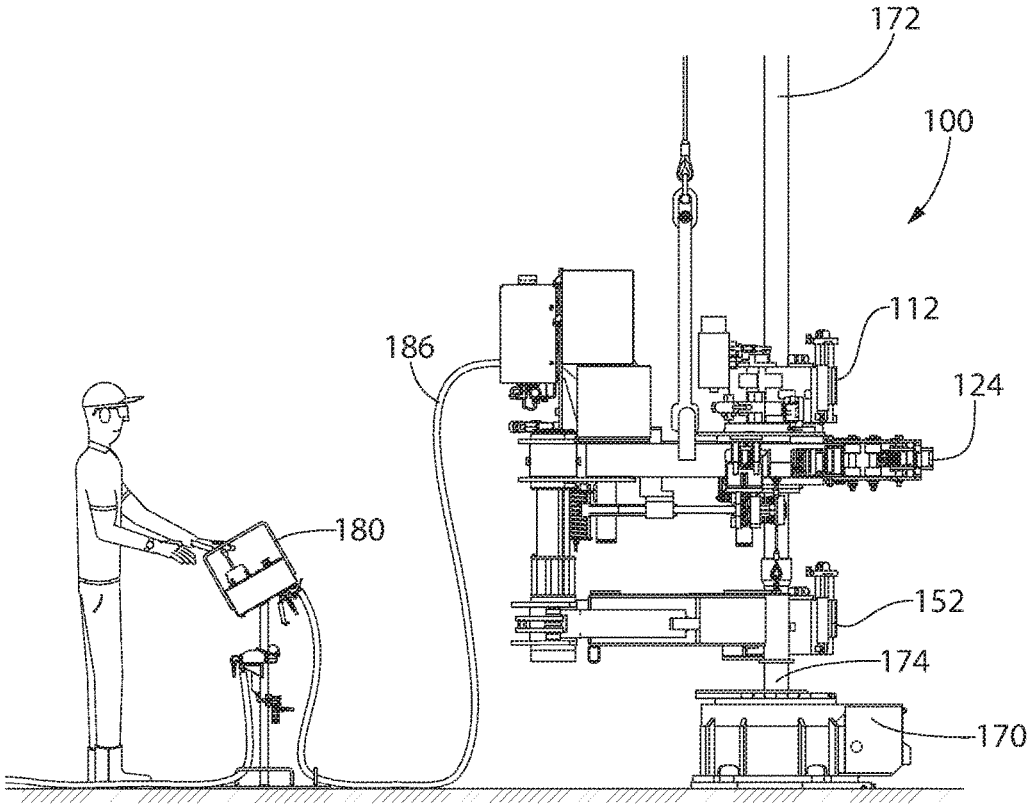
FIG. 16 illustrates a side view of the tubular gripping assembly releasing the tubular upper member and being removed from the center of the well, according to an embodiment.

The method 800 may also include opening the power tong Fluid Grip housing 112 and the backup tong Fluid Grip housing 152, as at 832. This is shown in FIG. 16. To open the power tong Fluid Grip housing 112, the latch cylinders 138 may extend (e.g., disengage), and then the hydraulic actuators 136 may actuate the power tong Fluid Grip housing 112 into the open position, as shown in FIG. 4B.

The method 800 may also include moving the tubular gripping assembly 100 away from the center of the well, as at 834. As the tubular gripping assembly 100 moves away from the center of the well, the upper tubular member 172 may exit the bore of the power tong Fluid Grip housing 112 by passing laterally-through the slots 116, 126 in the power tong Fluid Grip housing 112 and the power tong body 122, and the lower tubular member 174 may exit the bore of the backup tong Fluid Grip housing 152 by passing laterally-through the slot in the backup tong Fluid Grip housing 152.

As described above, one or more of the steps above (e.g., all of the steps) may be performed by transmitting signals from the remote control panel 180 to the tubular gripping assembly 100. This remote operation may allow the components to be actuated (e.g., hydraulically) without the conventional manual manipulation, allowing the user to be positioned safely away from the moving machinery.

Figure 17A:
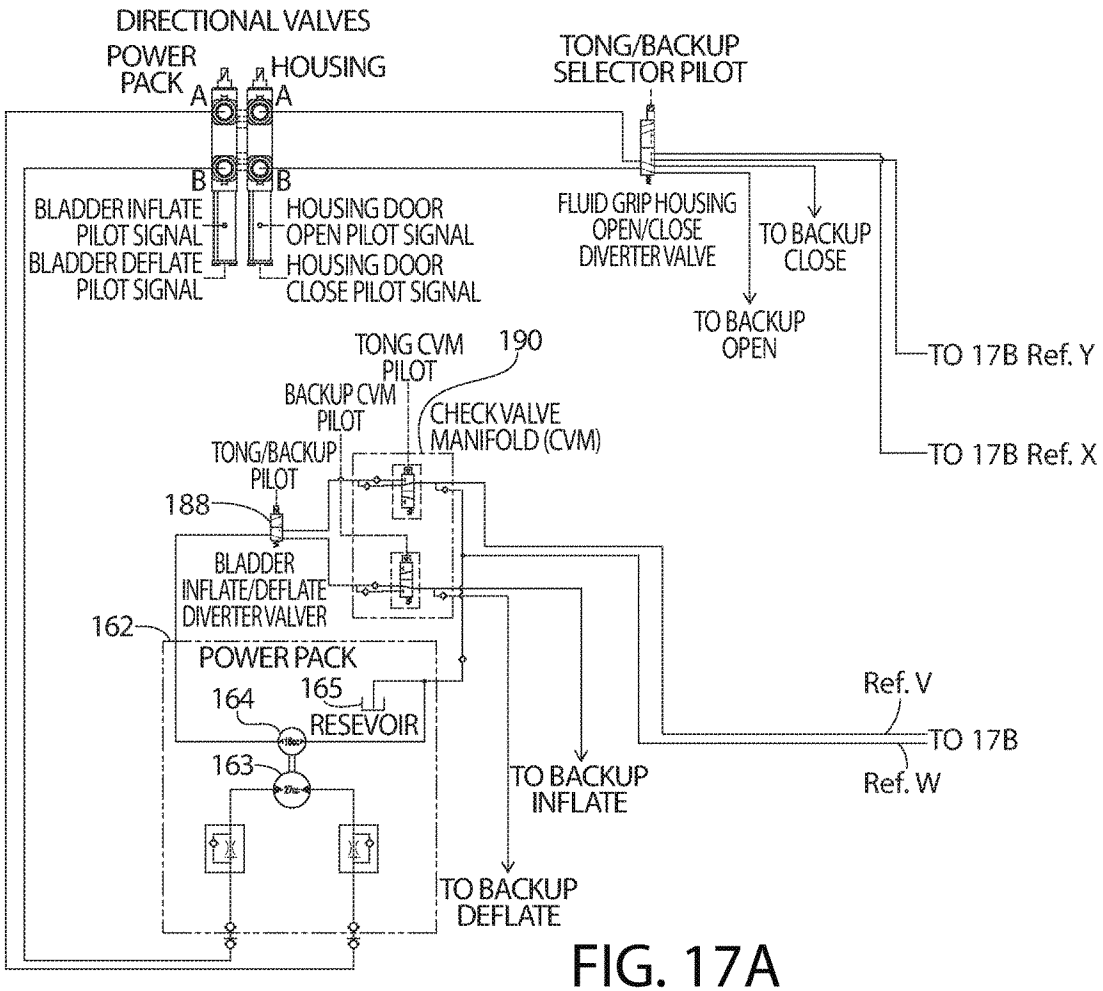
FIGS. 17A and 17B illustrate a schematic view of the tubular gripping assembly, according to an embodiment.
Figure 17B:
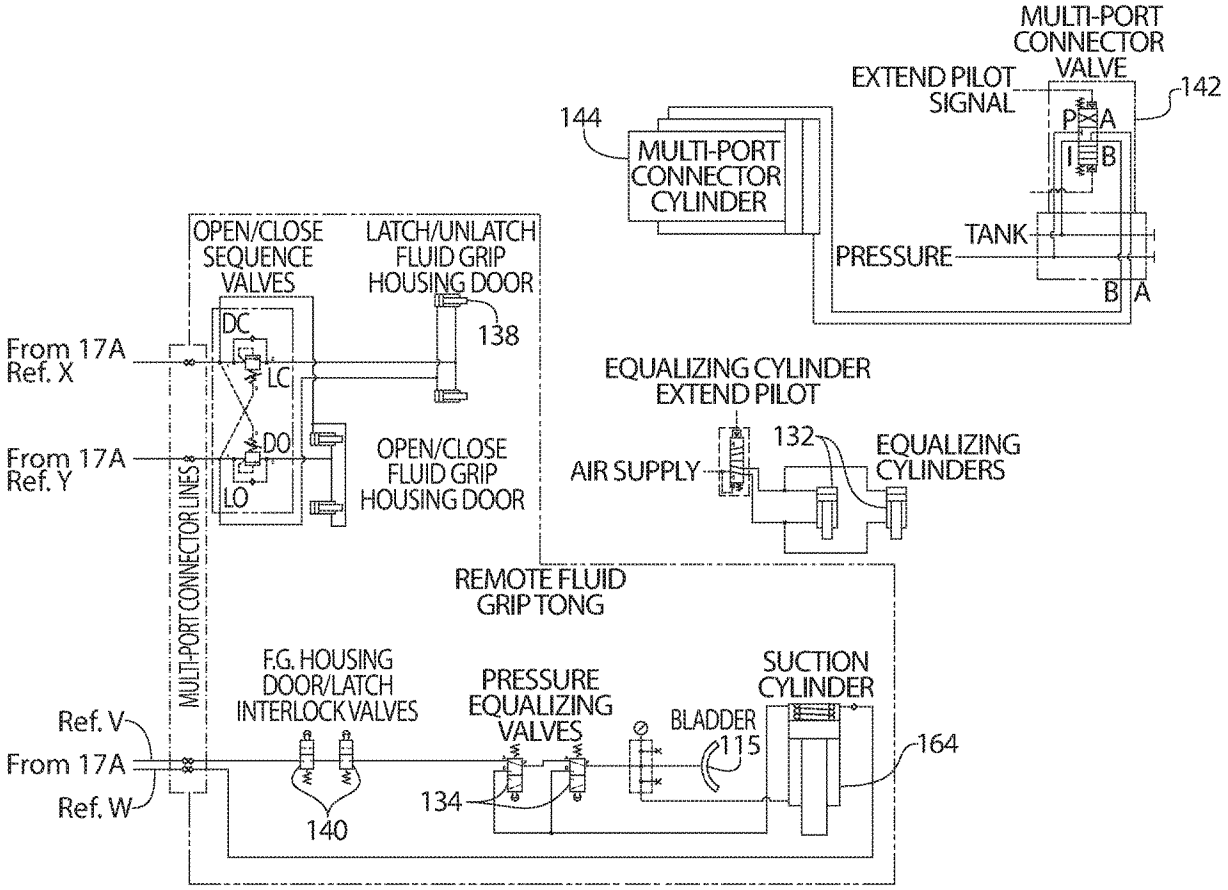

FIGS. 17A and 17B illustrate a schematic view of the tubular gripping assembly 100, according to an embodiment. The power tong Fluid Grip housing 112 of the tubular gripping assembly 100 may be supplied by the power pack 162, which is in turn energized by a primary hydraulic fluid power source that also provides hydraulic flow and pressure to the power tong drive motor 160 (see FIG. 1). The power pack 162 may include a hydraulic motor 163, a pump 164, and a reservoir 165. The power pack 162 may actuate the power tong Fluid Grip housing 112 via a closed-loop hydraulic system that is separate from the primary power source system. As opposed to the primary power source's continuous flow, the power pack 162 may cycle a small, isolated volume of fluid on a very intermittent basis, thereby minimizing the risk of the fluid overheating and possibly damaging the bladders 115 in the Fluid Grip assembly.

A diverter valve 188 may be positioned in the fluid path between the power pack 162 and the bladders 115 of the Fluid Grip apparatuses 114. The diverter valve 188 may provide two (or more) discrete paths to the power tong Fluid Grip housing 112 and the backup tong Fluid Grip housing 152. A check valve manifold 190 may be positioned between the diverter valve 188 and the power tong Fluid Grip housing 112. The check valve manifold 190 may include one or more valves that maintain high pressure in the bladders 115 in the power tong Fluid Grip housing 112 (and the bladders in the backup tong Fluid Grip housing 152, if present) while the multi-port connector 142 is docked. Once the multi-port connector 142 is undocked, the check valve manifold 190 may still maintain pressure in the bladders in the backup tong Fluid Grip housing 152, but pressure in the bladders 115 of the power tong Fluid Grip housing 112 may be maintained by quick-disconnect fittings. After the tubular members 172, 174 are connected (i.e., made up), one of two pressure-equalizing valves 134 may be actuated to allow the bladders 115 to depressurize, thereby releasing the grip on the tubular members 172, 174.

Bridging the gap in the fluid path between the previously-mentioned stationary components and the rotating members of the tubular gripping assembly 100 is the multi-port connector 142. The multi-port connector 142 may include four hydraulic lines: (1) bladder inflate, (2) bladder deflate, (3) power tong Fluid Grip housing open, and (4) power tong Fluid Grip housing close. The lines may pass through the multi-port connector 142 to a directional valve that controls signals to direct fluid through the multi-port connector 142 to devices that open/close and/or latch/unlatch components in the power tong Fluid Grip housing 112 and inflate/deflate the bladder 115. The multi-port connector 142 extends from the stationary portion of the tubular gripping assembly 100, and once docked with the mating connector mounted on the rotatable power tong Fluid Grip housing 112, it allows hydraulic fluid to flow to the rotatable power tong Fluid Grip housing 112.

Next in the fluid path are two interlock valves 140 that only permit fluid flow to proceed past this point once both door sections of the power tong Fluid Grip housing 112 are closed and the latch cylinders 138 are engaged. If the power tong Fluid Grip housing 112 is fully closed and latched, the fluid path extends to the bladders 115 and a retract port in the suction cylinder 166. Fluid entering the bladders 115 causes the bladders 115 to inflate to establish a secure grip on the tubular member 172. Fluid is simultaneously entering the retract port of the suction cylinder 166 which causes the cylinder piston and rod to retract which compresses the mechanical spring on the rear side of the piston. The compressed spring may store energy that will be used to withdraw fluid from the bladders 115 once the tubular connection has been made up. Once the bladders 115 and suction cylinder 166 have both been charged to the desired grip pressure, the multi-port connector 142 may be undocked. Once the grip is established and the multi-port connector 142 is undocked, the power tong Fluid Grip housing 112 rotates to assemble or disassemble (i.e., makeup/breakout) the tubular connection.

After makeup and/or breakout, the equalizing plates 130 may be moved upward by the equalizing cylinders 132 via a command signal from the remote control panel 180. Regardless of the final, post-rotation position of the power tong Fluid Grip housing 112, one of the equalizing plates 130 contacts at least one of the pressure-equalizing valves 134 disposed between the interlock valves 140 and the bladders 115. The activation of the pressure-equalizing valve 134 connects the bladders 115 to the rear port of the suction cylinder 166, which withdraws the hydraulic fluid from the bladders 115. Once the bladders 115 are depressurized and evacuated, an automated, remote-activation feature may be used to rotate the tong rotary gear and power tong Fluid Grip housing 112 until the slots 116, 126 are aligned. The multi-port connector 142 may again be docked, and re-pressurization forces residual fluid stored on the spring side of the suction cylinder 166 back into the reservoir 165 of the power pack 162. The latching cylinders 138 may then unlatch, allowing the power tong Fluid Grip housing 112 to open.

In an alternative embodiment, the power pack 162 may be replaced with an additional suction cylinder in order to provide improved suction. Also, rather than hydraulic fluid, water may be utilized. The use of water may eliminate the potential for hydraulic fluid spillage in the event of a bladder rupture.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A tubular gripping assembly, comprising:

a power tong housing configured to actuate between an open position and a closed position;

an inflatable bladder apparatus coupled to an inner surface of the power tong housing and configured to grip a tubular member when the power tong housing is in the closed position and the inflatable bladder apparatus is inflated; and a latch mechanism, operative in response to a remote control signal provided through a mechanized docking and undocking fluid connector, to secure the power tong housing in the closed position and to allow the power tong housing to actuate to the open position.

2. The tubular gripping assembly of claim 1, wherein the latch mechanism enables a flow of hydraulic fluid.

3. The tubular gripping assembly of claim 1, further comprising a hydraulic actuator coupled to the power tong housing, wherein the hydraulic actuator actuates the power tong housing between the open position and the closed position in response to another remote control signal.

4. The tubular gripping assembly of claim 1, further comprising a pressure-equalizing valve coupled to the power tong housing, wherein the pressure-equalizing valve causes the inflatable bladder apparatus to deflate in response to another remote control signal.

5. The tubular gripping assembly of claim 4, further comprising a suction cylinder, wherein the pressure-equalizing valve places the suction cylinder in fluid communication with the inflatable bladder apparatus to deflate the inflatable bladder apparatus.

6. The tubular gripping assembly of claim 4, further comprising:

an equalizing cylinder; and an equalizing plate, wherein the equalizing cylinder moves the equalizing plate into contact with the pressure-equalizing valve, causing the inflatable bladder apparatus to deflate.

7. The tubular gripping assembly of claim 1, wherein the mechanized docking and undocking fluid connector is configured to provide hydraulic communication to the tubular gripping assembly when in a docked position and to prevent hydraulic communication to the tubular gripping assembly when in an undocked position.

8. The tubular gripping assembly of claim 7, further comprising an arm, wherein the arm extends into contact with the mechanized docking and undocking fluid connector to place the mechanized docking and undocking fluid connector in the docked position, and wherein the arm retracts away from the mechanized docking and undocking fluid connector to place the mechanized docking and undocking fluid connector in the undocked position.

9. The tubular gripping assembly of claim 1, further comprising:

a power tong body coupled to the power tong housing, wherein the power tong housing defines a first slot when the power tong housing is in the open position, and the power tong body comprises a second slot;

a target block coupled to the power tong housing; and an auto-align valve coupled to the power tong body, wherein the auto-align valve and the target block are configured to determine whether the first and second slots are aligned.

10. The tubular gripping assembly of claim 1, further comprising:

a pressure relief mechanism, operative in response to another remote control signal, configured to deflate the inflatable bladder apparatus.

11. A method for connecting two tubular members, comprising:

aligning a power tong housing with a center of a well such that a tubular member is positioned within a bore of the power tong housing, wherein an inflatable bladder apparatus is coupled to an inner surface of the power tong housing;

closing the power tong housing in response to a first signal from a remote control panel;

inflating a bladder of the inflatable bladder apparatus in response to a second signal from the remote control panel, thereby causing the inflatable bladder apparatus to grip the tubular member;

undocking a mechanized docking and undocking fluid connector in response to a third signal from the remote control panel after the bladder is inflated, thereby interrupting hydraulic communication to the power tong housing; and rotating the power tong housing and the tubular member when the tubular member is gripped by the inflatable bladder apparatus.

12. The method of claim 11, wherein closing the power tong housing comprises:

actuating the power tong housing into a closed position using a hydraulic actuator; and actuating a latch actuator to cause a latch to secure the power tong housing in the closed position.

13. The method of claim 11, further comprising deflating the bladder in response to a fourth signal from the control panel after the power tong housing and the tubular member are rotated, wherein the inflatable bladder apparatus no longer grips the tubular member when the bladder is deflated.

14. The method of claim 13, wherein deflating the bladder comprises moving an equalizing plate using an equalizing cylinder, wherein, in response to being moved, the equalizing plate actuates a pressure-equalizing valve, thereby causing the bladder to deflate.

15. The method of claim 14, wherein, in response to being actuated, the pressure-equalizing valve places a suction cylinder in fluid communication with the bladder, causing fluid in the bladder to flow into the suction cylinder, thereby causing the bladder to deflate.

16. The method of claim 13, further comprising determining whether a first slot of the power tong housing is aligned with a second slot of a power tong body using a target block coupled to the power tong housing and an auto-align valve coupled to the power tong body.

17. The method of claim 16, further comprising rotating the power tong housing with respect to the power tong body to align the first and second slots.

18. The method of claim 17, further comprising docking the mechanized docking and undocking fluid connector, in response to a fifth signal from the remote control panel, after the first and second slots are aligned, thereby establishing hydraulic communication to the power tong housing.

19. The method of claim 18, further comprising opening the power tong housing in response to a sixth signal from the remote control panel after the mechanized docking and undocking fluid connector is docked.

20. A method for connecting two tubular members, comprising:

aligning a power tong housing with a center of a well such that a tubular member is positioned within a bore of the power tong housing, wherein an inflatable bladder apparatus is coupled to an inner surface of the power tong housing;

closing the power tong housing in response to a first signal from a remote control panel;

inflating a bladder of the inflatable bladder apparatus in response to a second signal from the remote control panel, thereby causing the inflatable bladder apparatus to grip the tubular member;

undocking a mechanized docking and undocking fluid connector in response to a third signal from the remote control panel, thereby interrupting hydraulic communication to the power tong housing;

rotating the power tong housing and the tubular member when the tubular member is gripped by the inflatable bladder apparatus;

deflating the bladder of the inflatable bladder apparatus in response to a fourth signal from the remote control panel, wherein the inflatable bladder apparatus no longer grips the tubular member when the bladder is deflated;

rotating the power tong housing with respect to a power tong body to align a slot in the power tong housing with a slot in the power tong body;

docking the mechanized docking and undocking fluid connecter in response to a fifth signal from the remote control panel, thereby establishing hydraulic communication to the power tong housing;

opening the power tong housing in response to a sixth signal from the remote control panel; and moving the power tong housing away from the center of the well.

21. The method of claim 20, wherein closing the power tong housing comprises:

actuating the power tong housing into a closed position using a hydraulic actuator; and actuating a latch actuator to cause a latch to secure the power tong housing in the closed position.

22. The method of claim 20, wherein deflating the bladder comprises moving an equalizing plate using an equalizing cylinder, wherein, in response to being moved, the equalizing plate actuates a pressure-equalizing valve, thereby causing the bladder to deflate.

23. The method of claim 22, wherein, in response to being actuated, the pressure-equalizing valve places a suction cylinder in fluid communication with the bladder, causing fluid in the bladder to flow into the suction cylinder, thereby causing the bladder to deflate.

24. The method of claim 20, further comprising determining whether the slot in the power tong housing is aligned with the slot in the power tong body using a target block coupled to the power tong housing and an auto-align valve coupled to the power tong body.

* * * * *